US006932501B2

(12) United States Patent
Wu

(10) Patent No.: US 6,932,501 B2
(45) Date of Patent: Aug. 23, 2005

(54) RAPIDLY-ASSEMBLED LAMP WITH A DETACHABLE LAMP ROD AND LAMP SEAT

(76) Inventor: Wen-Chang Wu, 235 Chung-Ho Box 8-24, Taipei (TW)

( * ) Notice: Subject to any disclaimer, the term of this patent is extended or adjusted under 35 U.S.C. 154(b) by 101 days.

(21) Appl. No.: 10/400,948

(22) Filed: Mar. 25, 2003

(65) Prior Publication Data

US 2004/0190306 A1 Sep. 30, 2004

(51) Int. Cl.[7] ..... F21V 21/00

(52) U.S. Cl. ..... 362/558; 362/404; 362/405; 362/406; 362/258

(58) Field of Search ..... 362/404, 405, 362/406, 258, 407, 558; 242/107.3

(56) References Cited

U.S. PATENT DOCUMENTS 4,300,732 A * 11/1981 Gaeta ..... 242/379.2
6,746,145 B1 * 6/2004 Wu ..... 362/581
6,805,477 B1 * 10/2004 Wu ..... 362/581
6,831,418 B1 * 12/2004 Wu ..... 315/76
6,851,829 B2 * 2/2005 Wu ..... 362/217
6,860,630 B2 * 3/2005 Wu ..... 362/581
2004/0190292 A1 * 9/2004 Wu ..... 362/249
2004/0190297 A1 * 9/2004 Wu ..... 362/368
2004/0190300 A1 * 9/2004 Wu ..... 362/418
2004/0190310 A1 * 9/2004 Wu ..... 362/581
2004/0201986 A1 * 10/2004 Wu ..... 362/226
2004/0201998 A1 * 10/2004 Wu ..... 362/410
2004/0208010 A1 * 10/2004 Wu ..... 362/410
2004/0213002 A1 * 10/2004 Wu ..... 362/382

* cited by examiner

*Primary Examiner*—Sandra O'Shea
*Assistant Examiner*—Anabel Ton

(57) ABSTRACT

A rapidly-assembled lamp with a detachable lamp rod and lamp seat is disclosed. The lamp seat has a penetrating hole at a position coupled to a via hole of the wire winding box. A side of the penetrating hole is formed with a slot. At a middle section of an inner periphery of the penetrating hole has an annular groove for buckling the lamp rod. A portion of the lamp rod is protruded with a positioning key. A C ring has a tapered shape so as to have a lager diameter opening which exactly protrudes from the surface of the lamp rod. After the lamp rod is inserted into the lamp seat, the inserting portion is inserted into the inserting seat so that the lamp seat is electrically conductive. Thereby, the lamp is detachable for storage and transfer with a smaller volume.

2 Claims, 5 Drawing Sheets

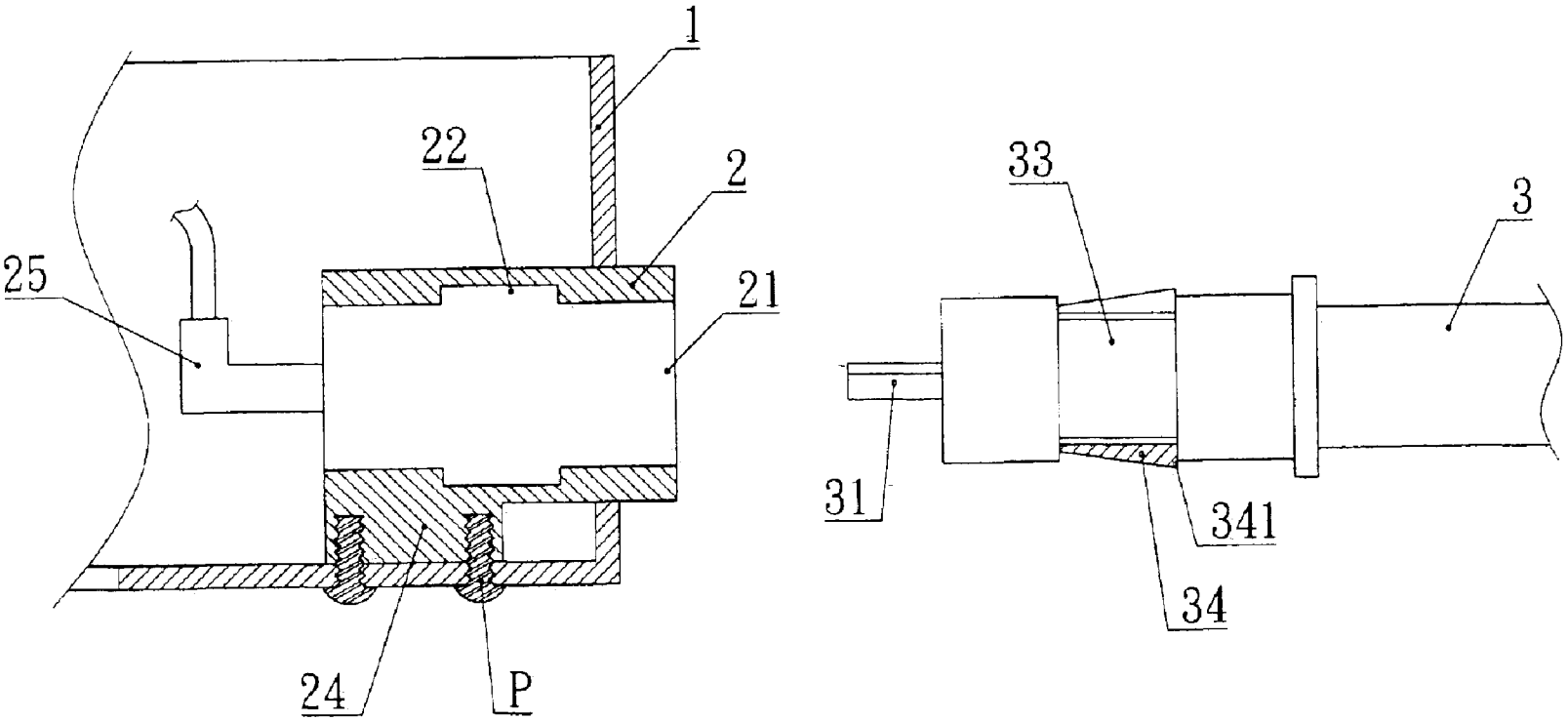
Fig. 3-A

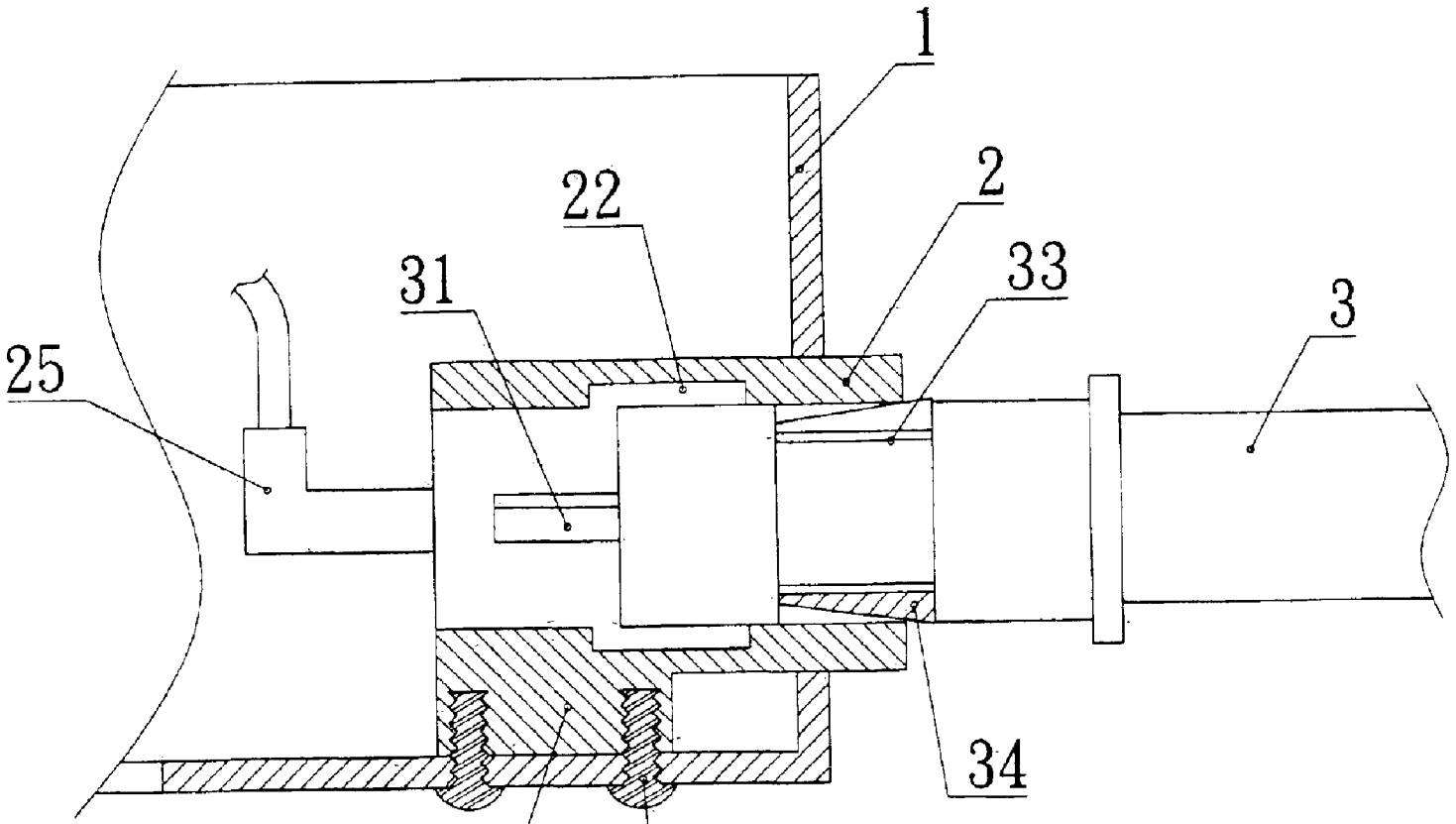
Fig. 3-B

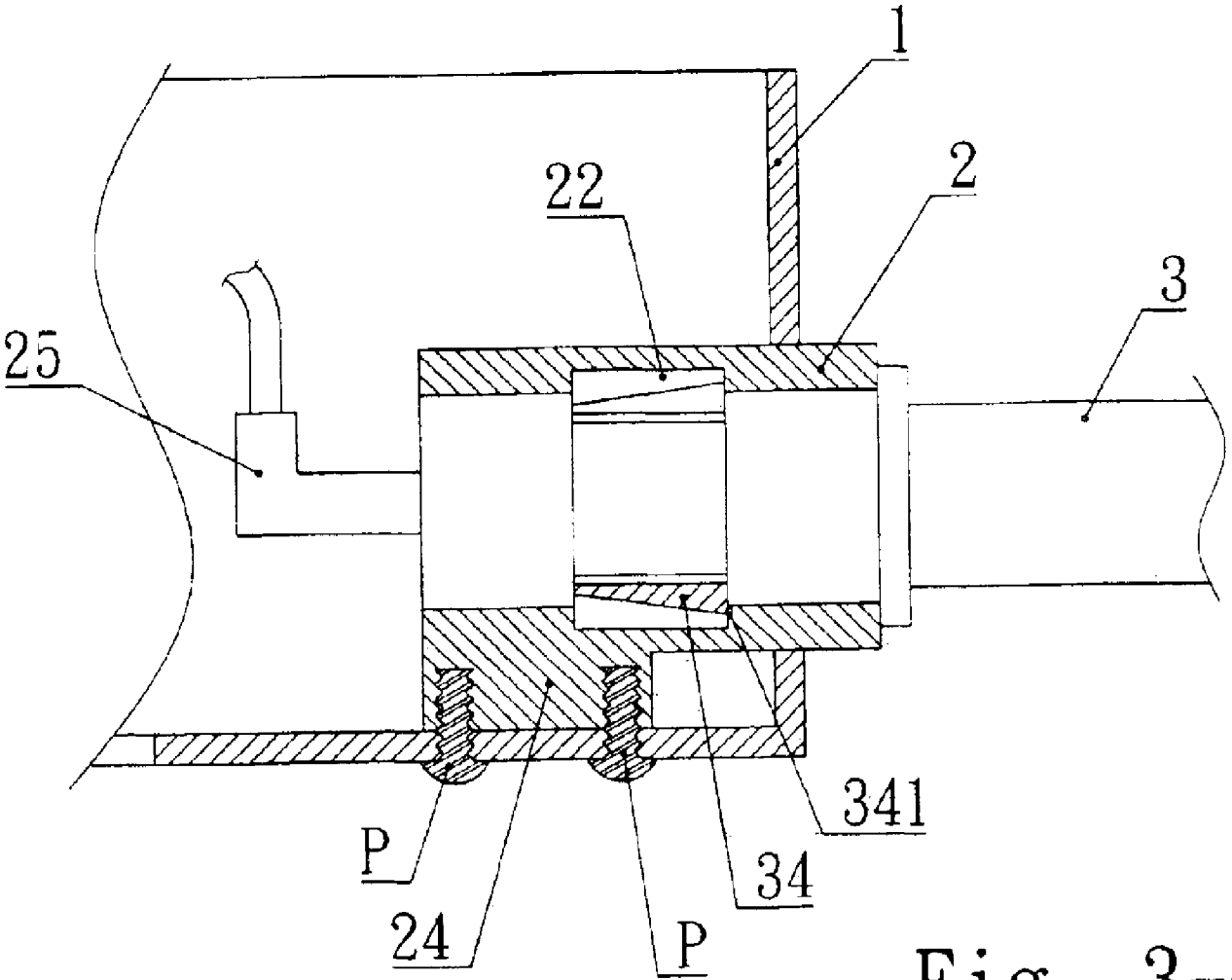
Fig. 3-C

RAPIDLY-ASSEMBLED LAMP WITH A DETACHABLE LAMP ROD AND LAMP SEAT

BACKGROUND OF THE INVENTION

The present invention relates to lamp assembly devices, and particularly to a rapidly-assembled lamp with a detachable lamp rod and lamp seat. By the design of the present invention, a user can assemble the lamp rod by inserting it into the lamp seat easily; thus, the lamp is detachable for storage and transfer with a smaller volume.

The prior art buckling structures of lamps, such as wall lamps, seat lamps, or stand lamps, are assembled by screwing studs with nuts. Not only the collision easy occurs, but also the locking tools (for example, spanners, openers, etc.) are necessary. In assembly, the wires will expose so as to generate electric shock. Moreover, the assembly work is tedious and thus it is unsuitable for being assembled by the users themselves. Thus generally, the wire winding box is assembled with the inserting rod before sale. Thereby, the cost is high and a larger space is necessary for transfer and storage.

SUMMARY OF THE INVENTION

Accordingly, the primary object of the present invention is to provide a rapidly-assembled lamp with a detachable lamp rod and lamp seat. The lamp seat has a penetrating hole at a position coupled to a via hole of the wire winding box. A side of the penetrating hole is formed with a slot. At a middle section of an inner periphery of the penetrating hole has an annular groove for buckling the lamp rod. A portion of the lamp rod is protruded with a positioning key. A C ring encloses around the neck portion; the C ring has a tapered shape so as to have a lager diameter opening which exactly protrudes from the surface of the lamp rod. After the lamp rod is inserted into the lamp seat, the inserting portion is inserted into the inserting seat so that the lamp seat is electrically conductive to the lamp rod. Thereby, a user can assembled the lamp rod by inserting it into the lamp seat easily; thus, the lamp is detachable for storage and transfer with a smaller volume.

The various objects and advantages of the present invention will be more readily understood from the following detailed description when read in conjunction with the appended drawing.

BRIEF DESCRIPTION OF THE DRAWINGS

FIG. 3A shows one embodiment before the insertion of the lamp rod.

FIG. 3B shows one the present invention in the insertion of the lamp rod.

FIG. 3C shows one embodiment after the insertion of the lamp rod.

BRIEF DESCRIPTION OF THE PREFERRED EMBODIMENTS

Figure 1:
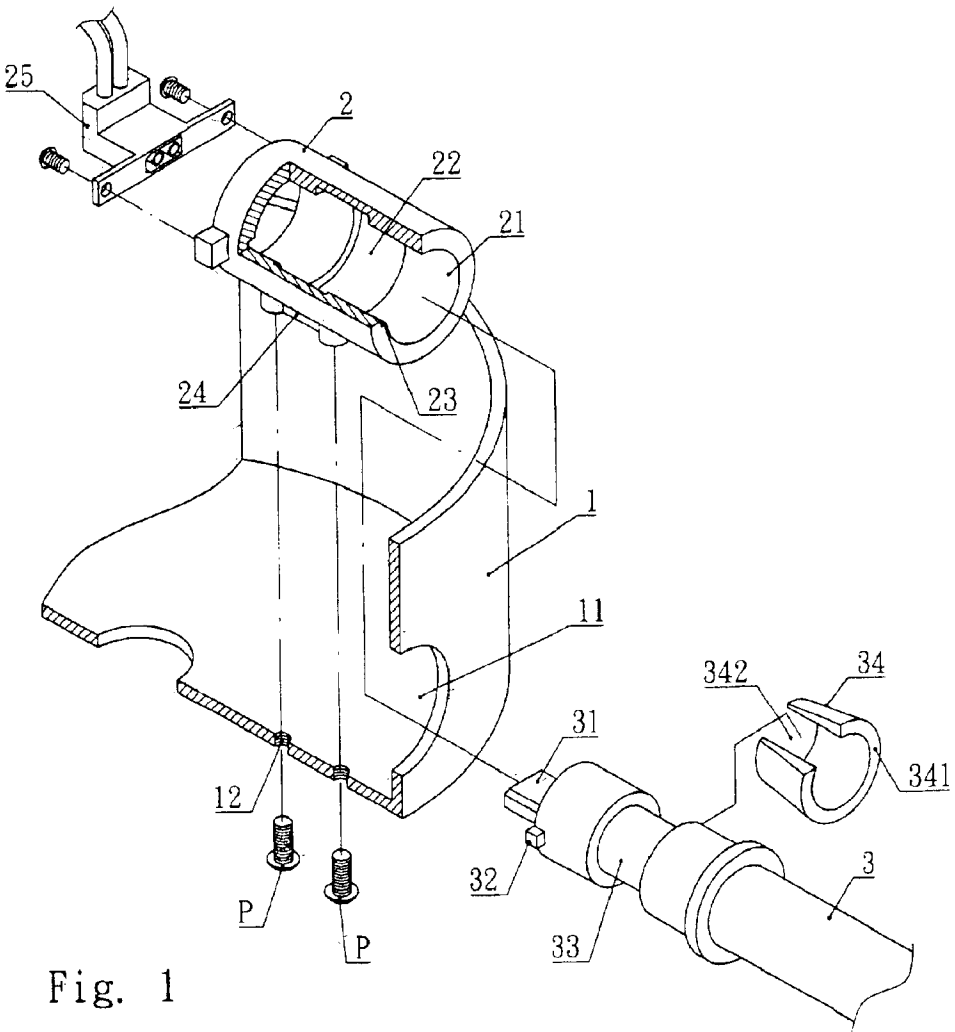
FIG. 1 is an exploded perspective view of the present invention.
Figure 2:
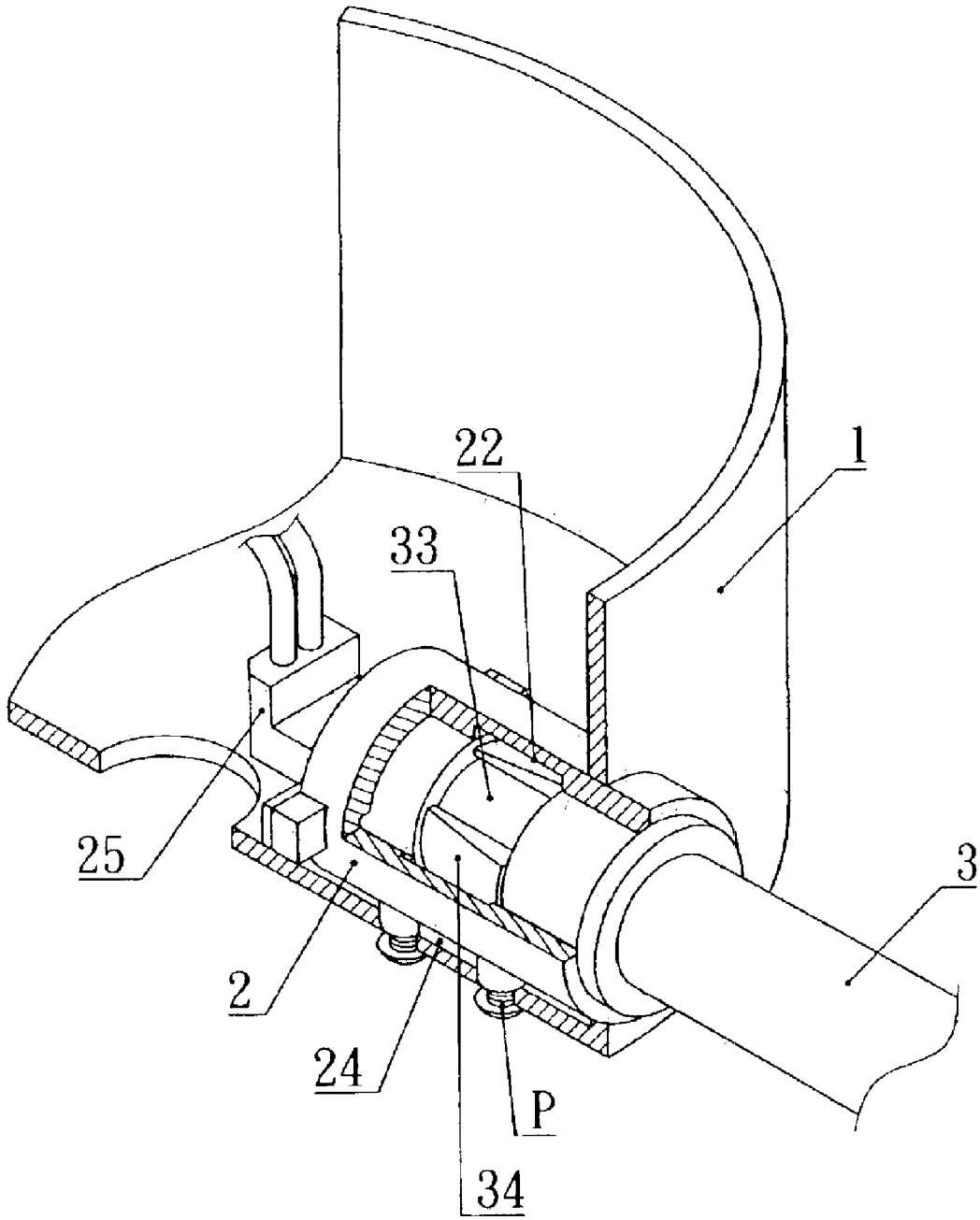
FIG. 2 is an assembled perspective view of the present invention.

Referring to FIGS. 1 and 2, the structure of the present invention is illustrated. The present invention includes a lamp seat 2 at a lower edge of a wire winding box 1 and a lamp rod 3 inserted in the lamp seat 2.

A lateral side of the wire winding box 1 has a via hole 11 and a bottom of the wire winding box 1 coupled to the lamp seat 2 has a through hole 12 for being passed by a stud P so as to lock the lamp seat 2 to a predetermined positioned A portion of the lamp seat 2 coupled to the via hole 11 of the wire winding box 1 has a penetrating hole 21 and a side of the penetrating hole has a slot 23; at a middle section of an inner periphery of the penetrating hole 21 has an annular groove 22 for buckling the lamp rod 3. A bottom of the lamp seat 2 protruded with a locking seat 24 with a configuration corresponding to the through hole 12 of the wire winding box 1, thereby the stud P can pass through the through hole 12 from a lower end of the wire winding box 1 and then is locked to the locking seat 22 so as to fix the lamp seat 2 to the wire winding box 1. A distal end of the lamp seat 2 is locked with an inserting seat 24 for positioning the end portion 31 of the lamp rod 3.

A front end of the lamp rod 3 is exactly inserted into the inserting portion 31 in the inserting seat of the lamp seat 2, a portion of the lamp rod 3 is protruded with a positioning key 32 at a position corresponding to the slot 23 of the lamp seat 2. The positioning key 32 exactly passes through the slot 23 of the lamp seat 2. A portion of the lamp rod 3 coupled to the annular groove 22 of the lamp seat 2 is formed with a neck portion 33 which is reduced from a surface of the lamp rod 3. A C ring 34 encloses around the neck portion 33. A C ring 34 has a tapered shape so as to have a lager diameter opening 341 which exactly protrudes from the surface of the lamp rod 3. A small diameter open end 342 of the C ring 34 provides a margin when the C ring 34 is compressed. Thereby, after the lamp rod 3 is inserted into the lamp seat 2, the lamp rod 3 can be confined by the C ring 34. After the lamp rod 3 is inserted into the lamp seat 2, the inserting portion 31 of the lamp rod 3 is inserted into the inserting seat 24 so that the lamp seat 2 is electrically conductive to the lamp rod 3.

Thereby, the user can assemble the lamp rod 3 by inserting it to the lamp seat 2 easily. Thus, the lamp can be detached for storage and transfer with a smaller volume.

With reference to FIG. 3, at first, the positioning key 32 of lamp rod 3 inserts into the slot 23 of the lamp seat 2. At this moment, the C ring 34 on the neck portion 33 of the lamp rod 3 is compressed by the penetrating hole 21 of the lamp seat 2. By the compressing margin of the C ring 34, the larger diameter opening 341 of the C ring 34 is compressed slightly toward the annular groove 22 (referring to FIG. 3B). When the lamp rod 3 is inserted continuously until the C ring 34 is aligned to the annular groove 22 of the lamp seat 2, since the C ring 34 is released from the compression of the penetrating hole 21, the larger diameter opening 341 will resilient outwards so that the larger diameter opening of the C ring 34 is exactly buckled with the end surface of the annular groove 22 (referring to FIG. 3C) so as to prevent the lamp rod 3 to release out. Thereby, the lamp rod 3 can be positioned on the lamp seat 2.

By above said structure, in transferring or storage, the lamp rod 3 and the wire winding box 1 can be detached in advance so as to reduce the volume. In use, the user only needs to insert the lamp rod 3 into the lamp seat 2 without using any locking tools. Thus, the user can assemble the lamp by himself (or herself).

The present invention is thus described, it will be obvious that the same may be varied in many ways. Such variations are not to be regarded as a departure from the spirit and scope of the present invention, and all such modifications as would be obvious to one skilled in the art are intended to be included within the scope of the following claims.

What is claimed is:

1. A rapidly-assembled lamp with a detachable lamp rod and a lamp seat; the rapidly assembled lamp comprising a lamp seat at a lower edge of a wire winding box and a lamp rod inserted into the lamp seat; wherein a lateral side of the wire winding box has a via hole and a bottom of the wire winding box coupled to the lamp seat has a through hole;

a portion of the lamp seat coupled to the via hole of the wire winding box has a penetrating hole and a side of the penetrating hole has a slot; at a middle section of an inner periphery of the penetrating hole has an annular groove for buckling the lamp rod; a distal end of the lamp seat is locked with an inserting seat for positioning an end portion of the lamp rod; and a front end of the lamp rod is exactly inserted into the inserting portion in the inserting seat of the lamp seat; a portion of the lamp rod is protruded with a positioning key at a position corresponding to the slot of the lamp seat; a portion of the lamp rod coupled to the annular groove of the lamp seat is formed with a neck portion which is reduced from a surface of the lamp rod; a C ring encloses around the neck portion; the C ring has a tapered shape so as to have a lager diameter opening which exactly protrudes from the surface of the lamp rod; an small diameter open end of the C ring provides a margin when the C ring is compressible; thereby, after the lamp rod is inserted into the lamp seat, the lamp rod is confined by the C ring; after the lamp rod is inserted into the lamp seat, the inserting portion of the lamp rod is inserted into the inserting seat so that the lamp seat is electrically conductive to the lamp rod;

thereby, a user can assemble the lamp rod by inserting it into the lamp seat easily; thus, the lamp is detachable for storage and transfer with a smaller volume.

2. The rapidly-assembled lamp with a detachable lamp rod and a lamp seat as claimed in claim 1, wherein a bottom of the lamp seat protruded with a locking seat with a configuration corresponding to the through hole of the wire winding box; a stud passes through the through hole from a lower end of the wire winding box and then is locked to the locking seat so as to fix the lamp seat to the wire winding box.

* * * * *